United States Patent [19]

Torroja

[11] 4,037,552

[45] July 26, 1977

[54] PROCESS FOR REDUCING THE STRESSES CAUSED BY THE VERTICAL BENDING OF A BOAT ON INDEPENDENT TANKS INSTALLED THEREIN

[75] Inventor: Jaime Torroja, Las Arenas, Spain

[73] Assignee: Sener, Tecnica Industrial Y Naval S.A., Las Arenas, Spain

[21] Appl. No.: 689,657

[22] Filed: May 24, 1976

Related U.S. Application Data

[63] Continuation of Ser. No. 527,591, Nov. 27, 1974, abandoned.

[30] Foreign Application Priority Data

Dec. 1, 1973 Spain ..... 421085

[51] Int. Cl.[2] ..... B63B 25/08

[52] U.S. Cl. ..... 114/74 R; 114/125

[58] Field of Search ..... 114/74 R, 74 T, 74 A, 114/121, 65 R, 124, 125, .5 R, 65 A, 56; 220/71, 72, 9 LG, 15; 62/45, 55

[56] References Cited

U.S. PATENT DOCUMENTS

| | | | |
|---|---|---|---|
| 3,004,509 | 10/1961 | Leroux | 114/74 A |
| 3,128,375 | 4/1964 | Grimnes | 114/125 X |
| 3,828,708 | 8/1974 | Gerwick, Jr. et al. | 114/65 A |
| 3,830,181 | 8/1974 | Tornay | 220/9 LG X |
| 3,841,269 | 10/1974 | Urruela | 114/74 R |
| 3,842,775 | 10/1974 | Edwards et al. | 114/74 R |
| 3,922,985 | 12/1975 | Hamilton | 114/74 R |
| 3,926,134 | 12/1975 | Closner et al. | 114/74 R |
| 3,927,788 | 12/1975 | Zinniger et al. | 114/74 A X |
| 3,977,350 | 8/1976 | Finsterwalder et al. | 114/74 A |

*Primary Examiner*—Trygve M. Blix
*Assistant Examiner*—Douglas C. Butler
*Attorney, Agent, or Firm*—Fleit & Jacobson

[57] ABSTRACT

A process for reducing the stresses in a vessel consisting of building a hull with a number of compartments and fitting into each an independent cargo tank for the storage of liquefied gas. Before the cargo tanks are fitted, the hull in the region of each compartment along the central transverse section thereof is subjected by ballasting to a predetermined vertical static bending moment in the absence of the tank, and thereafter each tank is installed in the hull while maintaining the predetermined vertical static bending moment so that the maximum stresses to which the tank will be subjected under different sailing conditions will be substantially reduced.

5 Claims, 4 Drawing Figures

CURVES
1. WEIGHT DISTRIBUTION
2. BUOYANCY DISTRIBUTION
3. SHEARING FORCE DIAGRAM
4. BENDING MOMENT DIAGRAM

PROCESS FOR REDUCING THE STRESSES CAUSED BY THE VERTICAL BENDING OF A BOAT ON INDEPENDENT TANKS INSTALLED THEREIN

This is a continuation of application Ser. No. 527,591, filed Nov. 27, 1974, now abandoned.

This invention relates to a process for reducing the stresses on independent cargo tanks installed on a vessel, induced by vertical bending of the vessel, and, more specifically, for reducing the stresses induced by vertical bending of the vessel on tanks intended mainly for transporting liquefied gases.

The sea transport of liquefied gases presents various technical problems, arising mainly from the motions and loads to which the ship is subject in a seaway, and also from the low temperatures at which most liquefied gases are transported. This is the case, for instance, with liquefied natural gas (LNG), which is transported at nearly atmospheric pressure and at about −160°.

The problems associated with low temperatures derive, on one hand, from the need to use special low-temperature materials in the cargo tanks, and on the other hand, from the need to prevent such low temperatures from being transmitted to the structure of the ship, with the corresponding risk of brittle fracture.

The techniques developed to perform this transport are basically the following:

a. The use of independent prismatic tanks, with metallic walls of special material which are relatively thick and fitted with stiffeners. These tanks are supported on the ship structure by means of supports of insulating material which prevent general movement of the tanks in relation to the ship in vertical, transverse and longitudinal directions, but permit thermal shrinkage and expansion of the tank.

b. The use of tanks which are integrated with the ship structure, such tanks consisting of one or more metallic barriers of special material and very low thickness, with intermediate layers of insulating material. In this solution, the pressures inside the tanks are transmitted through the metallic barriers and insulation, and are withstood by the inner shell of the ship. Thermal shrinkage or expansion of the metallic barriers is allowed either by fitting such barriers with corrugations, or by making the barriers of a material, such as (INVAR) alloy, the coefficient of thermal expansion of which is practically nil.

c. The use of tanks with thick, unstiffened metallic walls, made of special material, the geometrical configuration of which permits them to be designed as pressure vessels according to the Codes generally used for such type of vessels. These tanks are supported on the ship structure by means of a support system which prevents movement of the tanks relative to the ship but permits thermal shrinkage and expansions of the tank as its temperature varies. The support system may consist either of discrete support elements arranged on the three main planes of symmetry of the tank, which are supported on the hull through insulating elements, or of continuous shells, welded to the tank near its middle horizontal plane along their upper edges, and to the ship hull along their lower edges. In the latter case, the temperature of the ship hull does not drop below an acceptable value due to the large height of the support and also because, over a wide zone, next to their connection to the ship structure, the shells are uninsulated.

Whatever the type of solution adopted, the tanks and their support system are subject to the following loads:

a. Static loads:

1. Weight of the tank and of its support system.
2. Weight of structures inside the tank, including also pumps, piping and instruments.
3. Weight of insulation of the tank and of its support system.
4. Internal overpressure in the vapour chamber of the tank.
5. External overpressure while the tank is empty.
6. Internal pressure due to the liquid cargo in the tank.
7. Thermoelastic loads occurring when the temperature of the loaded tanks is lower than that of the ship structure.
8. Loads induced by static deformations of the ship structure, which are transmitted to the tank through its support system.

b. Dynamic loads:

1. Loads induced by accelerations of the ship in vertical, longitudinal and transverse directions.
2. Loads induced by deformations of the ship structure under dynamic conditions.

The nature of static loads is clear enough. However, some clarification may be needed in connection with dynamic loads, due to accelerations and deformations of the ship structure.

These dynamic loads are generally computed on the basis of long term sea state spectra corresponding to the North Atlantic, which are the most unfavourable. The extreme loads used for design purposes generally correspond to a probability of exceedence of $10^{-8}$. They are, thus, loads which will probably occur only once during the lifetime of the ship. The values of loads corresponding to higher probablity levels are also computed, in order to investigate the fatigue behaviour and, in certain cases, the stable growth of cracks in the tank shell.

The design process for the tanks and supports is governed, on general lines, by various regulatory bodies among which the most important are the Classification Societies and the U.S. Coast Guard. The nature of the design process depends on the possibility of a mathematical analysis of the behaviour of the tank and its support system.

Thus, in the case of integrated tanks, the analysis of which by means of mathematical methods is practically impossible, the design has to be based on static and dynamic tests with models. In the case of independent prismatic tanks, a certain degree of analysis by mathematical methods is possible, although the geometry of the tanks and the existence of stiffeners do not permit a complete mathematical treatment. Finally, in the case of pressure vessels, of simpler geometry, the treatment is almost all mathematical, the tests usually being limited to checking the mechanical properties of the materials and, more specifically, of the welded joints.

The different steps in the design process corresponding to tanks of the pressure vessel type are listed below. These steps are also partially applicable to the case of independent prismatic tanks and to that of integrated tanks.

1. Computation of static hull deformations for the different possible loading conditions.
2. Computation of accelerations for various probability levels.
3. Computation of dynamic hull deformations for various probability levels.

4. Computation of static directional stresses due to static hull deformations.
5. Computation of static directional stresses due to other static loads.
6. Computation of dynamic directional stresses due to accelerations, at probability level $10^{-8}$.
7. Computation of dynamic directional stresses due to hull deformations, at probability level $10^{-8}$.
8. Computation of total directional stresses (dynamic and static) for the same probability level.
9. Computation of total equivalent stresses for the same probability level.
10. Comparison of total equivalent stresses, for said probability level, and within each category (general membrane stresses, local membrane stresses, primary plus secondary stresses, peak stresses) with the maximum equivalent stresses permitted by the regulatory bodies.
11. Computation of cumulative fatigue damage during 20 years of ship's lifetime.
12. Comparison of the cumulative fatigue damage with the maximum allowed by the regulatory bodies.
13. Computation of stable growth of a through crack in the tank shell, during 15 days, under the worst sea conditions foreseeable during 20 years.
14. Computation of the critical crack length beyond which unstable propagation can occur.
15. Comparison of the critical crack length with the length of a crack after 15 days of stable growth, under the worst foreseeable conditions, and in accordance with the requirements of the regulatory bodies.
16. Computations of the local stability of the tank and support.
17. Computation of the general stability of the tank and support.

Whatever the cargo to be transported and the type of tank and support system adopted, it is obviously desirable to reduce the weight of the tank and of the support system. Assuming that the main particulars of the ship, the capacity of each cargo tank and the material to be used have been chosen, the weight of the tank and its support system can only be reduced significantly by reducing the load's induced by deformations of the ship structure, since the remainder of the loads previously mentioned are practically impossible to reduce, or, if they can be reduced, this does not involve any appreciable reduction in the weight of the tanks and supports.

The loads induced in the cargo tanks and in their supports systems by deformations of the ship structure can obviously be reduced by increasing the stiffness of the ship structure. Nevertheless, although this stiffness can be slightly increased by means of a rational design, there comes a point at which an increase in stiffness necessarily entails an increase in the weight of the ship structure, which would cause an increase in structural cost greater than the possible reduction in cost of the tanks and their support system.

Generally speaking, it does not seem advisable to give the ship a structural strength above the minimum required to withstand the external loads acting on the ship structure itself.

An alternative method to reduce the influence of the structural deformations of the ship can be derived from the analysis of the various types of deformations of the ship structure in way of a cargo tank.

These deformations can be broken down into the following types:

a. Local deformations of the structure in way of the support of a cargo tank. These deformations can be of a static or dynamic character, and their influence on the design of the tank and its support system is relatively small.

b. General deformations of the hull, considered as a beam, under the action of horizontal bending moments. Under static conditions these deformations are strictly nil, as the horizontal components of the hydrostatic pressures on both sides of the ship cancel each other at each transverse section. Under dynamic conditions the deformations are not nil, but are of a very small value, due, on the one hand, to the relatively low values of dynamic horizontal bending moments, and on the other hand, to the high value of the moment of inertia of the assembly of longitudinal structural members of the ship, at any transverse section, about the vertical axis of symmetry of the same.

c. General deformations of the hull, considered as a beam, under the action of torsional moments. For reasons of symmetry, these deformations are nil under static conditions, since the torsional moment is nil. Under dynamic conditions, these deformations are greater than those due to horizontal bending, since, although torsional moments are not very large, the torsional stiffness of the ship is relatively low.

d. General deformations of the hull, considered as a beam, under the action of vertical bending moments. Under static conditions, these deformations can become very large in liquefied gas carriers, since, due to the low density of the cargo, the ship is predominantly subject to hogging vertical static bending moments, which cause the deck to work under tension and the bottom and double bottom to work under compression. Under dynamic conditions, the ship is also subject to large vertical bending moments, both hogging and sagging.

Of all the deformations mentioned, those of dynamic character are not amenable to any significant reduction, unless the structural cost of the ship is appreciably increased.

As regards deformations of a static nature, we have already seen that those due to horizontal bending and to torsion are very low and, therefore, no significant action can be taken about them.

However, according to the process, which is subsequently described and which constitutes the main object of the invention, it is possible to act on deformations resulting from vertical bending of the hull. This process also involves, as a byproduct, a reduction in the stresses induced by local deformations on the independent cargo tanks.

Presently, in the majority of the types of the tanks used, the connection of the tanks to the ship structure is normally done while the ship is in the building berth or dock, resting on discontinuous building blocks.

This means, on one hand that, since the ship is built by welding together large sections which are supported on building blocks, when the cargo tanks are connected to the ship structure, the bending moment in any transverse section of the ship is practically nil. On the other hand, as the ship is supported on building blocks, the reactions of which are not easily controllable, temporary local deformations occur in the ship structure, which are practically impossible to determine.

If the cargo tanks are connected under these conditions, once the ship is put into service, it will, throughout its life, be subject to the aforementioned dynamic loads. Moreover, the structure of the ship in way of the tank supports, and more specifically, in way of the midship tanks, will be subject to a strong static vertical bending moment which will vary as a function of the various loading conditions of the ship, and which will cause a deformation of the structure which did not exist at the time of connecting the cargo tanks on the ship. As has already been stated, in liquefied gas carriers, and particularly in LNG carriers, the low specific gravity of the cargo causes this bending moment to be a hogging one under any loading condition, at least in the case of midship tanks.

In other words, the fact that the cargo tanks are connected while the hull is not subject to vertical static deformations causes large parasitic static stresses to occur in the cargo tanks and in their support systems throughout their lifetime.

This disadvantage is avoided, according to this invention, by connecting the cargo tanks while the hull, in any stage of completion, ia afloat and subject, in way of each tank, to a static vertical bending moment distribution with a magnitude of the static vertical bending moment, in the middle transverse section of the cargo tank, that induces a set of deformations approximately equivalent to those which the hull will sustain under average sailing conditions, thus performing the connection of the cargo tank to the hull through the support system and maintaining during this operation the same value of the above bending moment.

By the expression "connection of the cargo tank to the hull", the following is meant:

a. For the case of integrated tanks, the mounting on the inner shell of the ship of the walls formed by thin metallic barriers and by their insulation and the joining of the walls together to form the tank.

b. In the case of prismatic tanks of thick stiffened plates, the final fitting of the blocks of insulating material on which the bottom of the tank rests on the double bottom of the ship, performed after the cargo tank has been completed.

c. In the case of tanks of the pressure vessel type, with thick, unstiffened walls, resting on discrete supports, the final fitting of the discrete support elements which withstand vertical forces and their joining to the ship structure, after the cargo tank has been completed and located within the hull.

d. In the case of tanks of the pressure vessel type with thick, unstiffened walls supported on continuous shells, the final cutting of the edges of said shells furthest removed from the middle plane of the tank, according to a line parallel to the surface of the ship structure in the area of connection and their joining by welding to said structure after the tank and its support have been completed.

The aforementioned bending moment in each transverse section can be easily induced by suitably ballasting the vessel.

The process disclosed in the present invention is applicable to any vessel fitted with independent cargo tanks. However, the advantages derived from the use of the invention are maximized if the vessel is designed having in mind the later application of a vertical static bending moment, for the purpose defined above.

Thus, according to another characteristic of the invention, intended to obtain the maximum advantages from the aforementioned characteristic, the ship is designed, and its mode of operation is chosen in such a way that, for each of the transverse sections through the centre of each cargo tank, the range of variation of the static vertical bending moment does not exceed a predetermined fraction of the maximum vertical bending moment which the ship structure can withstand.

In the normal design of ships, one tries to ensure that the extreme static vertical bending moments, both hogging and sagging, do not exceed the permissible values in each transverse section. However, there is not special attempt, within each traverse section, to make the extreme bending moments similar in magnitude.

In the case of liquefied gas carriers, which constitute the great majority of the ships fitted with independent cargo tanks, maintaining the static vertical bending moments within the limits allowed by the structural strength of the ship does not present any special difficulties, due to the low specific gravity of the cargo (0.5 Tm/m3 in the case of LNG) and to the low length-/depth ratio which involves a high value of the cross section modules for the whole of the longitudinal structural members.

This allows special attention to be paid in designing the ship in such a way that, for each transverse section, the extreme values of the static vertical bending moment are very similar when the ship is in operation and, consequently, very close to the value of the bending moment applied on the hull during the connection of the tank to the same, according to the first characteristic of the invention.

In the case of large LNG carriers, this is relatively easy to achieve since, due to the existence of a double shell, the volume available for ballast allows, in way of each cargo tank, a weight of ballast (salt water) almost equal to that of a full cargo in the corresponding tank. Since this occurs for each cargo tank, this means that the longitudinal distributions of weight and buoyancy and, consequently, those of shearing froce and bending moment can be maintained fairly equal under full load and ballast conditions.

Also, as regards consumables, and, especially fuel, very similar longitudinal weight distributions can be obtained for port departure with full consumables and for arrival with no consumables. This may be achieved by providing ballast tanks, with similar capacities to those of fuel tanks, and placing them next to the fuel tanks longitudinally, that is, at the forward and aft ends of the ship, where fuel tanks are normally located.

From the point of view of operating the ship, there is no special problem in ensuring that the deviations of the static vertical bending moment in any transverse section, from the average value predetermined for said section, do not exceed an absolute maximum value, also predetermined.

This can easily be achieved by means of small computers, presently available in the market, which, on the basis of the ship's geometry, the longitudinal distribution of light weight and the level inidications of cargo, ballast and consumable tanks provide directly the value of the static vertical bending moment in any transverse section of the ship or the value of its deviation from a given value of comparison.

These computers, whose cost in negligible in comparison with the reduction in cost which can be achieved in the cargo tanks, can be fed by signals transmitted by remote level gauges in the cargo, ballast and consumable tanks. They can also operate an alarm if, as a result of mishandling the static vertical bending moment in any section moves beyond the maximum/minimum permissible limits.

According to the invention, the design of the ship and the selection of its operational mode involve the following step:

i. Tentative selection of ship's geometry, including distribution of geometrical spaces for cargo, ballast and consumables.

ii. Computation of the static vertical bending moment for the transverse section passing through the centre of each cargo tank, and for each possible loading condition under which the ship can operate.

iii. Checking that all the values of the above moments are within such limits that the scantlings of longitudinal members in the hull structure need not be increased beyond the values set by local strength requirements. This is a usual check when designing ship structures.

iv. Checking that the difference between the two extreme values of the static vertical bending moment at the transverse section through the centre of each cargo tank does not exceed a predetermined value.

v. In case the checkings (iii) and (iv) are not satisfactory, modification of the permissible loading conditions, and, consequently, of the longitudinal distributions of cargo, ballast and consumables, without modifying the distribution of geometrical spaces. This modification thus refers to the mode of operation of the ship, but not to the design itself. The loading conditions are modified until the check (iii) and (iv) give a satisfactory result, or until such result proves to be impossible to reach.

iv. If a satisfactory result of checks (iii) and (iv) cannot be obtained by just changing the mode of operation of the ship, the design itself must be modified. Thus, the ship's geometry and the spaces intended for cargo, ballast and consumables are redistributed. The steps (i) to (iv) are repeated until checks (iii) and (iv) give satisfactory results.

Once the design of the ship and its mode of operation are chosen, the magnitude of the static vertical bending moment to be applied at the transverse section through the centre of each cargo tank must be chosen, in such a way that the desired pattern of deformations is obtained.

The various steps in the process can be summarized as follows:

a. Computation of ship accelerations and dynamic moments, at $10^{-8}$ probability level, under the various possible loading conditions.

b. Computation of the patterns of deformation of the hull, in way of each cargo tank, corresponding to the static vertical bending moments and to the dynamic moments referred to in (a).

c. For the transverse section through the centre of each cargo tank, selection of a static vertical bending moment, the value of which is between the average of the two extreme values of the static vertical bending moment and the average of the two extreme values of the total (static and dynamic) vertical bending moment, at the same transverse section, under the various possible loading conditions of the ship. The selected static vertical bending moment must be able to induce, in way of the corresponding cargo tank, a pattern of deformations similar to the one occurring under average sailing conditions.

d. Design of the cargo tanks and their supports. The design work is based on the geometrical distribution selected for the ship, on the accelerations and deformations mentioned in a) and b) respectively, and on the static vertical bending moments selected according to c).

e. Repetition of steps c) and d), until an optimum design is chosen for each tank and its support. Each selected design is associated with an optimum value of the static vertical bending moment at the transverse section through the corresponding cargo tank.

f. Selection of a distribution of ballast which induces, at the transverse section through the centre of each cargo tank, a static vertical bending moment equal to the one selected in (e).

g. Independent construction of the ship hull and of the cargo tanks and their supports, according to the designs chosen for each of them.

h. Installation and positioning of the cargo tanks, with their supports, into the ship's hull, without performing the final connection.

i. Putting the ship afloat, by launching or by flooding the building dock.

j. Ballasting the ship, in accordance with the ballast distribution determined in (f), so as to obtain the required pattern of deformations of the hull in way of each cargo tank.

k. Performing the final connection of each cargo tank to the ship's hull, as explained before.

l. Operation of the ship according to the selected operational mode. For this purpose, the Captain will be provided with a Loading Manual, containing detailed instructions for loading, unlaoding, ballasting, deballasting and managing consumables, so as to maintain the static vertical bending moment within the prescribed limits. In addition, a small computer or equivalent apparatus can be installed to monitor the value of the above bending moment.

The magnitude of the static vertical bending moment to which the hull must be subjected in each of the stated transverse sections will vary according to the factors which govern the design of the tanks and their supports.

This bending moment can be approximately equal to the average of the two extreme values of the static vertical bending moment which will occur on the said transverse sections under various laoding conditions.

The adoption of this bending moment may be of particular interest when the design of the tank and its support, at least in large areas of the same, is governed by static loads.

Alternatively, the static vertical bending moment to which the hull is subject at each of said transverse sections, can be approximately equal to the average of the two extreme values of the total vertical bending moment, static and dynamic, which will occur in said transverse sections under various sailing conditions.

It should be noted that, in general, this average of the two extreme values of the total vertical bending moment will be different from the average of the two extreme values of the static vertical bending moment since, for a determined probability level, the sagging dynamic vertical bending moment is different from the hogging one.

As regards the probability level to be considered, it will preferably be $10^{-8}$, since this is the value usually taken for design purposes.

The adoption of this moment may be of special interest when the design of the tank and its support, at least in large areas of the same, is governed by dynamic loads.

Finally, the static vertical bending moment to which the hull is subject, can take an intermediate value between those stated above. The adoption of such intermediate moment may be of interest when the limiting design factors are partly static and partly dynamic.

Of course, the aforementioned bending moments are applicable when the final connection of the tanks to the hull is carried out after the hull structure has been completed. Otherwise, these bending moments will have to be reduced in order to obtain, during the final connection of the tank to the hull, a pattern of deformations equal to that which the bending moments previously mentioned would produce on the hull structrue once completed.

The bending moments chosen can be applied on the hull either to obtain the desired deformation pattern simultaneously in way of all cargo tanks, or to obtain the said deformation pattern successively in way of the various cargo tanks.

The advantages of the elimination, by this invention from the cargo tank and its support system, of the parasitic stresses induced by vertical bending moments acting on the ship structure, are applicable whatever the type of tank used. On the other hand, the effect of this elimination can be felt at all stages of the design process outlined at the beginning of this disclosure These advantages are very noteworthy in the case of large pressure vessels, for instance of spherical shape, supported on continuous shells, joint to the tank near its equatorial plane. In this case the thickness of the upper hemisphere of the tank, particularly in the area nearest the equator; is dictated by considerations of elastic stability, which becomes critical when the ship is sailing with empty cargo tanks, and also during loading and unloading operations, when the level of liquid cargo is near the equator.

Under such conditions, a relatively small compressive stress in the tank shell can cause buckling in the area immediately above its connection to the support. This occurs because the thickness of the tank shell is very small in comparison with its diameter.

Under the aforementioned conditions, the main component of the compressive stress, in the upper hemisphere of the tank, comes from deformations of the ship structure due to vertical bending, which are transmitted to the tank through the support.

In order to understand the phenomenon, let us conside a tank of the type mentioned, installed on board a ship subject to a hogging vertical bending moment, which can be static or dynamic.

Under the action of such bending moment, the lower edge of the support, which is welded to the ship structure, will deflect in such a way that the two ends of its longitudinal diameter will move down and the ends of its transverse diameter will move upwards, in relation to their position when there is no hogging moment.

At the same time, the upper edge of the support which is attached to the tank at the equator will tend to deflect in such a way that the length of its longitudinal diameter increases and that of its transverse one decreases. On the other hand, both ends of the longitudinal diameter will tend to move downwards whilst those of the transverse one will tend to move upwards.

Let us now consider the pattern of deformations of the lower hemisphere of the tank, which is welded to the upper edge of the support.

The action of the support on the lower hemisphere will tend to move both ends of its longitudinal diameter downwards and those of the transverse diameter upwards. The lower hemisphere being subject to such vertical deformations, its longitudinal diameter will tend to become longer, whilst its transverse diameter will tend to become shorter.

Consequently, the pattern of deformations of the lower hemisphere is, qualitatively, the same as that of the support. This means that the interactive forces and, consequently, the stresses, will tend to be relatively small, their value depending on the stiffnesses of both elements.

Let us now consider the pattern of deformations of the upper hemisphere of the tank, when the support and the lower hemisphere are deformed as previously described.

Under the action of the support and the lower hemisphere, the longitudinal diameter of the upper hemisphere will tend to lengthen, whilst the transverse diameter will tend to shorten. At the same time, the ends of the longitudinal diameter of the upper hemisphere will tend to move upwards whilst those of the transverse diameter will tend to move downwards.

It thus happens that, when the pattern of horizontal deformations of the upper hemisphere coincides with that of the support and of the lower hemisphere, the pattern of vertical deformations of said upper hemisphere is contrary to that of the former.

On the other hand, as the two hemispheres and the upper edge of the support have practically the same diameter, the deformations, both horizontal and vertical, of the three elements, will have to be identical. Therefore, the fact that the pattern of deformations of the upper hemisphere is opposite to that of the support and of the lower hemisphere means that, in order to satisfy the conditions of compatibility of deformation, very great interactive forces will have to appear between the upper hemisphere, on one side, and the lower hemisphere and the support, on the other, Consequently, large stresses will arise, particularly, in the upper hemisphere, which is working against the other two elements.

In the case of a tank situated near the mid-lengthof the ship, and since, in said area, hogging static vertical bending moments are large, the compressive stresses which appear in the upper hemisphere, near the equator and in the transverse plane of the tank, are sufficiently large to require an important increase in the thickness of the shell of said hemisphere, if the tank has been installed on board without taking the measureswhich characterize this invention.

Another advantage of the invention lies in the fact that, whatever the type of tank, if it is connected to the ship while it is afloat, the hydrostatic pressure acting in each area of the ship's bottom, is known and has a continuous distribution, similar to the one occurring under service conditions. However, if the connection of the tank to the ship is carried out while the latter is resting on the building blocks, which give rise to unknown local pressures, the state of loads anddeformations of the ship structure cannot be calculated, even as an approximation.

It is clear, therefore that by applying the invention, the harmful effect of local deformations of the ship structure referred to earlier, can be eliminated.

BRIEF DESCRIPTION OF THE DRAWINGS:

The characteristics and advantages of the present invention can be more easily understood with the help of the following description, which refers to the attached drawings, where:

In FIG. 1, the vertical strokes marked A, B, C, D and E corresponds to the positions of the transverse sections through the centres of the various cargo tanks of said LNG carrier.

Figure 1:
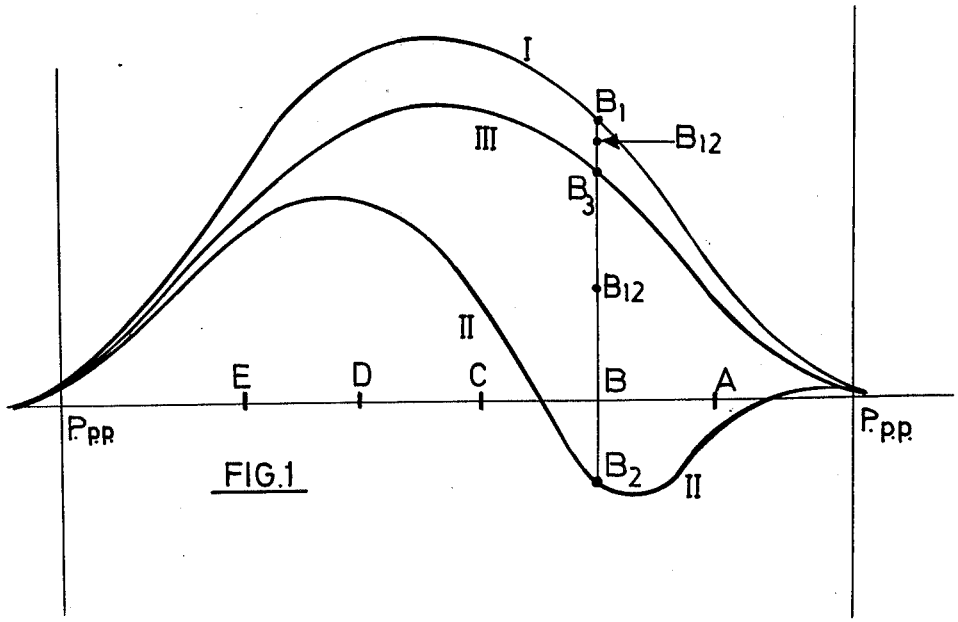
In FIG. 1, the maximum and minimum static vertical bending moments to which the various transverse sections of an LNG carrier are subject, are shown. On the abscissa, the distances from each transverse section of the ship to the aft perpendicular are shown, whilst the ordinates represent values of the static vertical bending moment. Hogging moments, which put the ship's deck under tension, are shown above the horizontal axis, while sagging moments, which put the deck under compression, are shown below said axis.

Curve I of FIG. 1 represents, for each transverse section, the value of the maximum static vertical bending moment, which occurs when the ship is under full load. As can be seen all along Curve I, the moment is a hogging one (positive) in any section.

Curve II of FIG. 1 represents the minimum value of the static vertical bending moment for each section, which occurs when the ship is in ballast, for a ship the design and the operating mode of which have been selected without taking special precautions. The moments are predominantly hogging, but there is an area, foward, where sagging moments (negative) occur.

Curve III of said FIG. 1 shows, for each section, the minimum value of the static vertical moment, which occurs in ballast, for a ship in which the arrangement of the ballast and consumable tanks, and the mode of operation have been selected with a view to obtain a distribution of minimum static bending moments which is very similar to that of the maximum static bending moments.

If the tanks are connected to the hull while the ship is still resting on the building blocks, the static vertical bending moment in any section will be nil, and the maximum parasitic stresses induced in any of the tanks and supports will be proportional to the highest value of the maximum static vertical bending moment when the ship is in operation, e.g., for tank No. 2 of the ship to which reference is made in FIG. 1, the maximum parasitic stresses will be proportional to the segment $BB_1$. Consequently, the maximum value of the static parasitic stress depends solely on the maximum value of the static vertical bending moment, represented in Curve I, and does not depend on the adaption of special measures to control the range of variation of said moment.

Let us now consider the case of a ship in which no special measures are adapted to control the variation of the static vertical bending moment, but in which the same tank No. 2 has been connected to the hull while the latter was subject to a bending moment (hogging) as shown in FIG. 1 by the point $B_{12}$, which is the middle point of the segment $B_1B_2$.

In this case, the maximum absolute value of the static parasitic stresses induced on the tank and the support will no longer be proportional to the segment $BB_1$, but to the segment $B_2B_{12} = B_{12}B_1 = \frac{1}{2}B_2B_1 < BB_1$.

This means that, though no special measures have been taken to control the range of variation of the static vertical bending moment in each section, the maximum parasitic stresses have been considerably reduced by connecting the tanks to the hull whilst it was subject to a suitable bending moment.

Let us now see what happens in the case of a ship in which measures have been adapted to control the variation of the static vertical bending moment, and in which, furthermore, tank No. 2 has been connected to the hull while this was subject to a bending moment (also hogging) represented in FIG. 1 by the point $B_{13}$, the middle point of the segment $B_1B_3$. In this case, the absolute maximum value of the parasitic static stresses induced on the tank and its support will be proportional to the segment $B_3B_{13} = B_{13}B_1 = \frac{1}{2}B_3B_1 < \frac{1}{2}B_2B_1 < BB_1$.

Therefore, when the adaption of measures to control the range of variation of the static vertical bending moment in each section is combined with imposing a suitable bending moment on the hull, before carrying out the connection of the tank to the hull, the parasitic stresses of static origin are radically reduced.

In order to give a comparative idea of said stresses, we can state what happens in the case of the tank No. 2 of the ship to which FIG. 1 refers. If a value equal to unity is attributed to the static stresses which arise without taking measures to control bending moments and without deforming the hull while connecting the tank to it, the value corresponding to the case where the hull is deformed while connecting the tank to it, without taking measures to control the bending moment in service, is 0.62. And, in case the predeformation of the hull is conbined with measures to control the bending moments, the value is reduced to 0.15.

Figure 2:
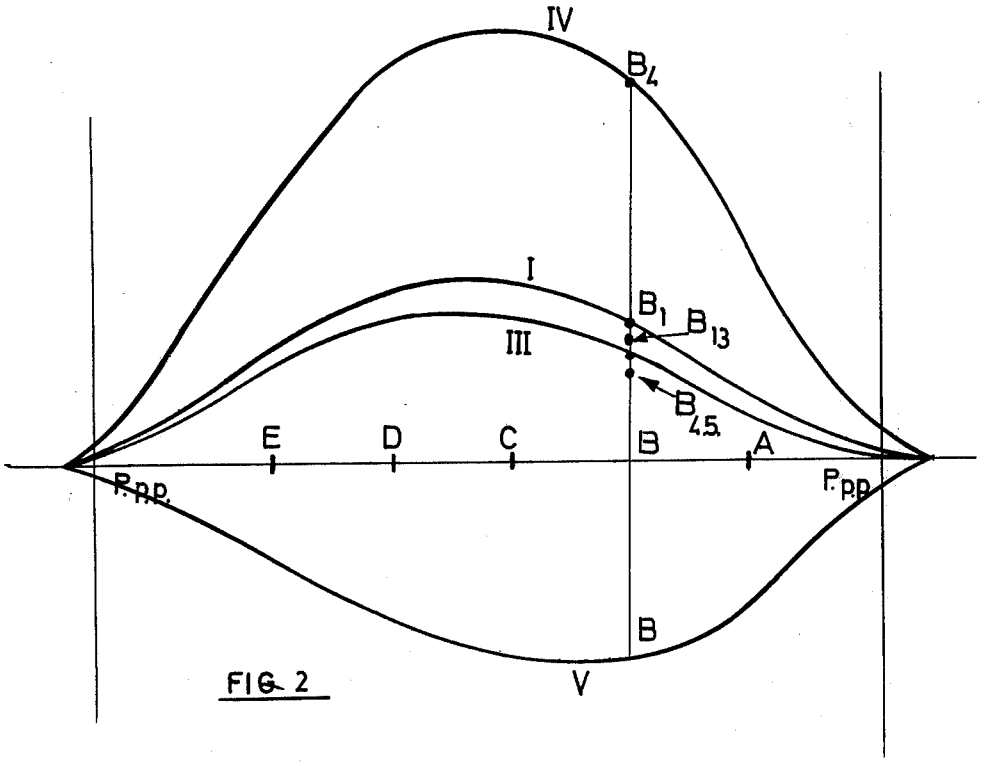
FIG. 2 shows the vertical bending moments, both static and total (that is, static plus dynamic) to which the various transverse sections of the same LNG carrier referred to in FIG. 1 are subject. The abscissa represents the same magnitude as in FIG. 1, and the ordinates, the static and total moments. Also, as in FIG. 1, hogging moments are shown above the horizontal axis and sagging moments are shown below it.

Curves I and III of FIG. 2, although shown on a smaller scale, are the same as Curves I and III of FIG. 1 and represent, therefore, the maximum and minimum values of the static vertical bending moment in each section. Curve II has not been shown since FIG. 2 refers to the case where the design and mode of operation of the ship have been studied so as to minimise the range of variation of the static vertical bending moment in each section.

Curve IV of FIG. 2 represents, for each transverse section, the value of the maximum total vertical bending moment (hogging), corresponding to probability level $10^{-8}$. For the case of tank No. 2, the segment $BB_1$ represents the maximum static moment, while the segment $B_1B_4$ represents the dynamic hogging moment, at $10^{-8}$ probability level.

On the same FIG. 2, Curve V represents, for each transverse section, the value of the minimum total vertical bending moment (sagging) corresponding to the aforementioned probability level. For tank No. 2, segment $BB_3$ represents the minimum static moment, while segment $B_3B_5$ represents the dynamic sagging moment, at probability level $10^{-8}$.

In the case of the ship to which FIG. 2 refers, it can be seen that the difference in ordinates between curves III and V is larger than the difference in ordinates between curves IV and I. This means that, is absolute value, sagging dynamic vertical bending moments are greater than the hogging ones.

The various options possible as regards the value of the bending moment to be applied to the complete ship's hull, at the transverse plate through the centre of each tank, can be seen diagrammatically in FIG. 2, with particular reference to tank No. 2.

When the design of the tanks and supports is governed by static loads, it will be appropriate to apply to the ship's hull, while connecting the tank, a moment defined by points such as $B_{13}$, the middle point of the segment $B_1B_3$. In this way, the parasitic stresses induced by static vertical bending moments will be minimized.

When, on the contrary, the design of the tanks and supports is governed by total loads (static and dynamic), it will be appropriate to apply to the hull, while connecting the tank, a moment defined by points such as $B_{45}$, the middle point of the segment $B_4B_5$, with which the stresses induced by total (static and dynamic) vertical bending moments will be minimized.

Finally, in those cases where the design is governed partly by static loads and partly by total loads, the bending moment to be applied shall be defined by an intermediate point between $B_{13}$ and $B_{45}$.

Figure 3:
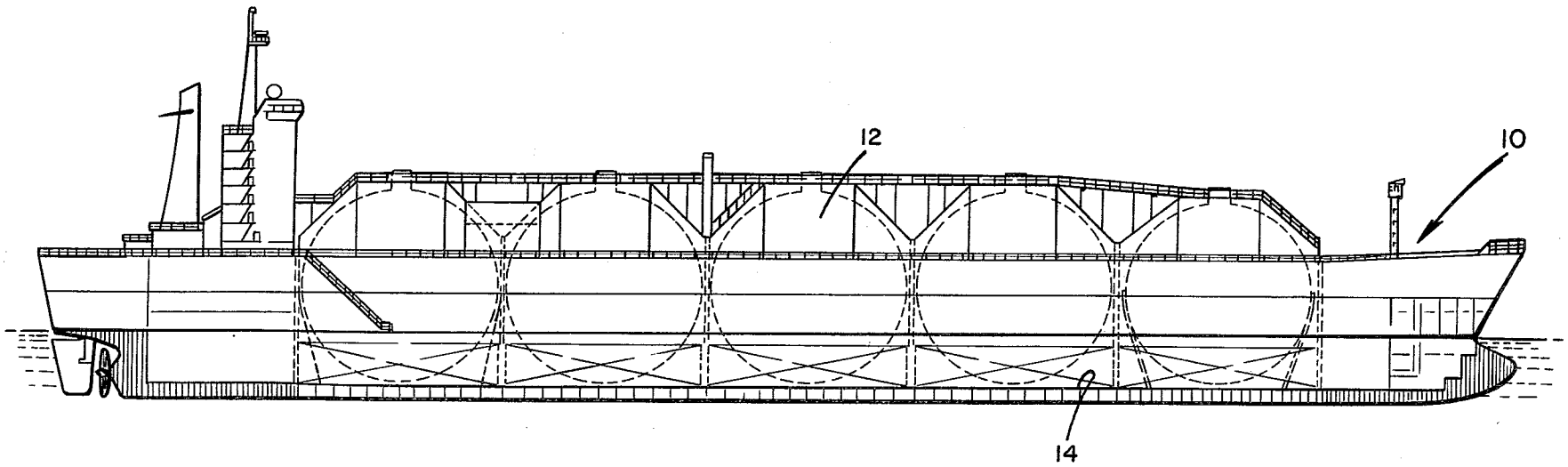
FIG. 3 shows in side elevation a typical known ship construction to which the principles of the invention can be applied.

Turning to FIG. 3, there is shown a known LNG ship 10 with self supporting spherical tanks 12 of the type as disclosed during the Second LNG Transportation Conference sponsored by Shipbuilding and Shipping Record held in London October 23-24, 1973, in a paper by J. Torroja Menendez, entitled "Sener's LNG Containment System — Basic Principles and Design Process". This "ship" has a capacity of 126,000 cu. m. and uses five cargo tanks and the hull arrangement includes ballast tanks 14 in the double bottom and the sides.

Figure 4:
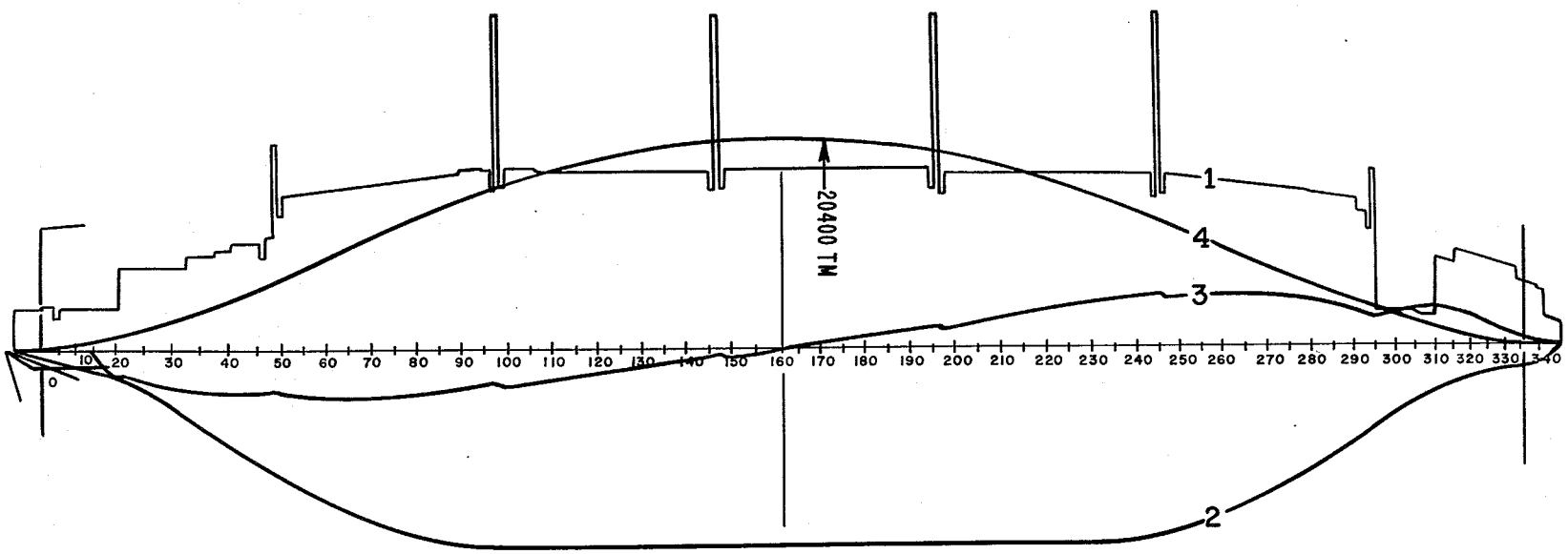
FIG. 4 shows, by way of example, the vertical bending moment to be induced in a ship hull of the type shown in FIG. 3 prior to and concurrent with attachment of the No. 3 tank.

FIG. 4 shows the curves for weight distribution, buoyance distribution, shearing force diagram and bending moment diagram for the known LNG ship 10 portrayed in FIG. 3. FIGS. 3 and 4, which portray a known LNG ship and some of its known characteristics, are included for illustrative purposes only and no claim for novelty is made herein regarding any structural aspect of the ship design shown.

In the homeward voyage of such LNG carrier as shown in FIG. 3, it carries only one type of cargo and in its tanks. This cargo distribution gives a fixed and irreducible static vertical bending moment for the hull girder. In the outward voyage, ballast is always carried together with a small amount of natural gas for cooling down purposes. In this vessel there is plenty of space for ballasting and it is easy to ballast the vessel in such a way as to impart to the vessel a bending moment similar to that experienced during the loaded condition.

Table I gives the numerical values in metric tonmeters of the static vertical bending moments at the center of each cargo tank for each of the following conditions:

1. FULL LOAD, departure (specific gravity of cargo = 0.5 T/m3).
2. FULL LOAD, departure (specific gravity of cargo = 0.478 T/m3).
3. BALLAST, departure.
4. FULL LOAD, arrival (specific gravity of cargo = 0.478 T/m3), after sailing 7,000 miles.
5. FULL LOAD, arrival, after sailing 10,000 miles.
6. BALLAST, arrival, after sailing 7,000 miles.

One will note that all values are positive indicating hogging in all conditions (negative values would indicate sagging.)

TABLE I

STATIC VERTICAL BENDING MOMENTS-(IN METRIC TON-METERS)

| Condition | TANK NUMBER 1 | 2 | 3 | 4 | 5 |
|---|---|---|---|---|---|
| 1 | 95,000 | 217,000 | 282,000 | 273,000 | 174,000 |
| 2 | 97,000 | 223,000 | 291,000 | 283,000 | 181,000 |
| 3 | 107,000 | 235,000 | 283,000 | 258,000 | 173,000 |
| 4 | 105,000 | 208,000 | 257,000 | 240,000 | 148,000 |
| 5 | 72,000 | 206,000 | 285,000 | 275,000 | 175,000 |
| 6 | 91,000 | 200,000 | 245,000 | 231,000 | 175,000 |

Table II gives the values of the dynamic vertical bending moments at the center of each cargo tank for all headings at a $10^{-8}$ probability level — as has been proposed by Det Norske Veritas.

Using the underlined values from Table I for the static vertical bending moments in each tank, the optimum preloading static vertical bending moments can be determined by averaging the total (static plus dynamic) bending moments for the maximum and minimum conditions. For example, for Tank No 3 the preloading moment is:

$$\frac{291000 + 430000}{2} + \frac{245000 - 558000}{2} = \frac{204000}{\text{metric ton-meters}}$$

Table III gives the preloading values obtained.

TABLE II

DYNAMIC VERTICAL BENDING MOMENTS (METRIC TON-METERS)

| Tank No. | 1 | 2 | 3 | 4 | 5 |
|---|---|---|---|---|---|
| Dynamic Vertical Bending Moment (Positive) (Hogging) | +245000 | +410000 | +430000 | +38000 | +240000 |
| Dynamic Vertical Bending Moment (Negative) (Sagging) | −315000 | −530000 | −558000 | −500000 | −320000 |

TABLE III

STATIC VERTICAL BENDING MOMENTS USED FOR PRELOADING

| Tank No. | 1 | 2 | 3 | 4 | 5 |
|---|---|---|---|---|---|
| Pre-loading Moment (metric ton-meters) | +54500 | +157600 | +204000 | +197000 | +124500 |

To achieve the bending moment of 204,000 metric tonmeters for tank No. 3, seawater is filled into the ballast tanks 14 according to Table IV whereupon the bending moment distribution shown in FIG. 4 is achieved and the desired bending moment appears at the mid transverse plane of cargo tank No. 3.

TABLE IV

| BALLAST TANK | WEIGHT - METRIC TONS |
|---|---|
| DOUBLE BOTTOM N. 1 | 869.8 |
| DOUBLE BOTTOM N. 1 | 869.8 |

TABLE IV-continued

| BALLAST TANK | WEIGHT - METRIC TONS |
|---|---|
| DOUBLE BOTTOM N. 2 | 1394.8 |
| DOUBLE BOTTOM N. 2 | 1394.8 |
| DOUBLE BOTTOM N. 3 | 1496.7 |
| DOUBLE BOTTOM N. 3 | 1496.7 |
| DOUBLE BOTTOM N. 4 | 1457.4 |
| DOUBLE BOTTOM N. 4 | 1457.4 |
| DOUBLE BOTTOM N. 5 | 1053.0 |
| DOUBLE BOTTOM N. 5 | 1053.0 |
| FORE PEAK | 1680.7 |
| PLATFORM TANK 1 | 5222.0 |
| PLATFORM TANK 2 | 4425.0 |
| PLATFORM TANK 3 | 5002.0 |
| PLATFORM TANK 4 | 4736.0 |
| PLATFORM TANK 5 | 4794.0 |
| LOWER WING TANK 5P&S | 395.0 |

The weights for each ballast tank, to create the desired bending moment, are determined according to known techniques, such as those disclosed in the *Principles of Naval Architecture* published by The Society of Naval Architects and Marine Engineers, New York, N.Y., 1967, edited by John P. Comstock.

I claim:

1. A process for reducing the stresses in a vessel comprising the steps of, providing a hull having a plurality of zones in each of which an independent cargo tank for the storage of material, such as liquefied gas, is to be installed, subjecting the hull in each of said zones along a central transverse section with respect to the tank to be installed therein to a predetermined vertical static bending moment in the absence of the tank by adjusting the ballasting of the hull while it is afloat, and installing each of the tanks in said hull within its respective zone while maintaining said predetermined vertical static bending moment on said zone whereby the maximum stresses to which the tank will be subjected under different sailing conditions will be substantially reduced.

2. A process according to claim 1, wherein the hull is subjected to a predetermined vertical static bending moment in each of said zones along the mid-transverse section of each said zone.

3. A process according to claim 1, wherein the vertical static bending moment to which the hull is subjected is, in each of the said zones, approximately equal to the average of the two extreme values of the vertical static bending moment which are produced in the said zone under the various sailing conditions.

4. A process according to claim 1, wherein the vertical static bending moment to which the hull is subjected is, in each of the said zones, approximately equal to the average of the two extreme values of the total, static and dynamic, vertical bending moments which are produced on the said transverse section under the various sailing conditions.

5. A process according to claim 1, wherein the vertical static bending moment to which the hull is subjected takes, in each of the said zones, an intermediate value between the average of the two extreme values of the static vertical bending moments and the average of the two extreme values of the total vertical bending moments, static and dynamic, which are produced on the said zone under the various sailing conditions.

* * * * *